United States Patent [19]

Bimonte et al.

[11] Patent Number: 4,694,972

[45] Date of Patent: Sep. 22, 1987

[54] APPARATUS FOR REFUSE COLLECTION AND DISPOSAL

[76] Inventors: Michael Bimonte, 1863 64th St., Brooklyn, N.Y. 11204; Dennis Cleary, 46 Barth St., Staten Island, N.Y. 10308

[21] Appl. No.: 826,313

[22] Filed: Feb. 5, 1986

[51] Int. Cl.[4] ..... A63B 55/04

[52] U.S. Cl. ..... 220/401; 220/1 T; 220/404

[58] Field of Search ..... 220/404, 403, 401, 1 T, 220/400, 1 H; 229/1.5 B, 1.5 H

[56] References Cited

U.S. PATENT DOCUMENTS

| | | | |
|---|---|---|---|
| 967,368 | 8/1910 | Grigsby | 229/1.5 B |
| 1,052,379 | 2/1913 | Ranken et al. | 220/401 X |
| 1,773,927 | 8/1930 | Mills | 229/1.5 H |
| 2,761,480 | 9/1956 | Tames | 383/16 |
| 3,028,134 | 4/1962 | Nolen | 220/1 T |
| 4,267,997 | 5/1981 | Meier | 220/1 T X |

*Primary Examiner*—Steven M. Pollard

*Attorney, Agent, or Firm*—Robin, Blecker & Daley

[57] ABSTRACT

Apparatus for use in refuse collection and disposal comprises a base adapted for securement to a substrate and for releasable receipt of a non-self-standing liner. The base includes an upstanding frame having an uppermost opening for receipt of the liner, the frame being configured such as generally to preclude the base from use for containment of refuse of customary small size in the absence of residence of the liner therein.

7 Claims, 7 Drawing Figures

APPARATUS FOR REFUSE COLLECTION AND DISPOSAL

FIELD OF INVENTION

This invention relates generally to containers for refuse collection and disposal and pertains more particularly to improved apparatus for such purpose.

BACKGROUND OF THE INVENTION

The typical practice of municipal refuse control is the provision of numerous collection bins or wastebaskets at street intersections and the periodic collection of the bin contents for ultimate disposal at a waste center. Such practice has been undermined to some extent by the theft of the wastebaskets, which are portable and usable by the thief, e.g., for leaf burning in the suburban communities.

One effort to overcome this problem has been the introduction of refuse containers which are not readily portable, e.g., concrete collection bins. Where intended for use as linerless, such concrete bins present difficulties to the daily collection practice effort, which must be mechanized with equipment adapted to lift the concrete bin and invert same to collect the bin contents.

A further effort to overcome the theft problem and at the same time permit manual, mechanically-unassisted daily collection, the art has seen the introduction, in non-portable collection bins, of readily removable liners which are not self-standing in the absence of the support provided by the non-portable collection bin and hence not attractive to theft. As presently known, such liners are of synthetic plastics and seat in a circular opening in the collection bin, the liners including an upper portion extending radially outwardly of the liner to seat upon the collection bin adjacent such opening therein. The liner has an upper portion of generally cylindrical outline extending to a lower portion in frustro-conical outline in turn extending to a bottom or base flat surface of rather small measure. The result is that the liner is not self-standing, but will topple when placed with such small base flat surface on a substrate without benefit of supporting structure.

While the theft problem has been substantially reduced by the last-noted development, several shortcomings still attend the current state of the art. Thus, there is a tendency for the public to use the linerless, non-portable collection bin as a refuse container, since it has the appearance of being such. Also, the presently known form of non-self-standing liners have handling disadvantage for daily collection personnel.

In addition to the problem of the theft of refuse or litter receptacles, a wire mesh basket, commonly used by municipalities, is relatively heavy and, even when empty, may weigh approximately thirty-eight pounds, thus making it more difficult for a worker to lift. Furthermore, wire baskets may be expensive, costing as much as thirty-nine dollars each. Moreover, such wire mesh baskets are aesthetically undesirable since refuse and litter therein is readily seen.

SUMMARY OF THE INVENTION

The present invention has as its object the provision of an improved refuse container.

A more particular object of the invention is the provision of improved refuse collection and disposal apparatus.

Another object of the invention is the provision of a lightweight, inexpensive refuse container that is easy and convenient to empty and is of theft-discouraging configuration.

A further object of the invention is the provision of refuse collection apparatus overcoming the above-discussed disadvantages of presently known apparatus.

In the efficient attainment of the foregoing and other objects, the invention provides apparatus for use in refuse collection, comprising a base adapted for securement thereof to a substrate and for releasable receipt of a non-self-standing liner, the base including an upstanding frame having an uppermost opening for receipt of the liner, the frame being configured such as generally to preclude the base from use for containment of refuse of customary small size in the absence of residence of the liner therein.

Liners in accordance with the invention are inclusive of handling structure additional to that presently known and affording more effective handling thereof by daily collection personnel. Liners of the invention may be made of lightweight plastic materials such as rigid, molded polyethylene, making them inexpensive, aesthetically attractive and easy to handle. An empty liner may weigh about ten pounds. In addition to savings resulting from a marked drop in theft of the containers, the combination of the base and the liner of the invention is appreciably less expensive than the commonly used open wire mesh litter baskets.

The foregoing and other objects and features of the invention will be further understood from the following detailed description of preferred embodiments thereof and from the drawings wherein like reference numerals identify like parts and components throughout.

DESCRIPTION OF PREFERRED EMBODIMENTS AND PRACTICES

Figure 1:
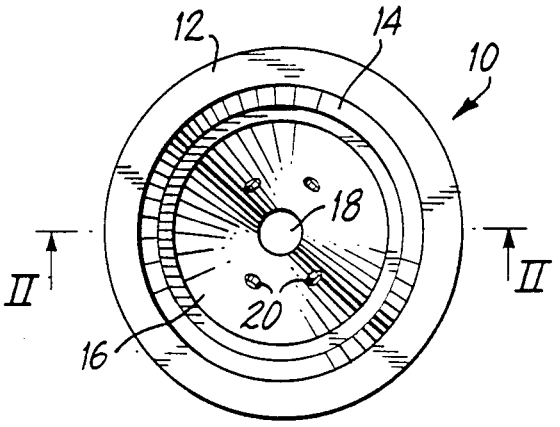
FIG. 1 is a top plan view of a refuse collection liner in accordance with the invention.
Figure 3:
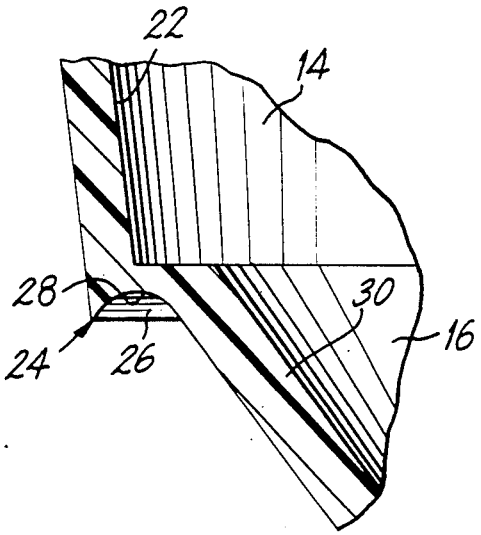
FIG. 3 is an enlarged sectional view of a portion of the FIG. 1 liner.
Figure 2:
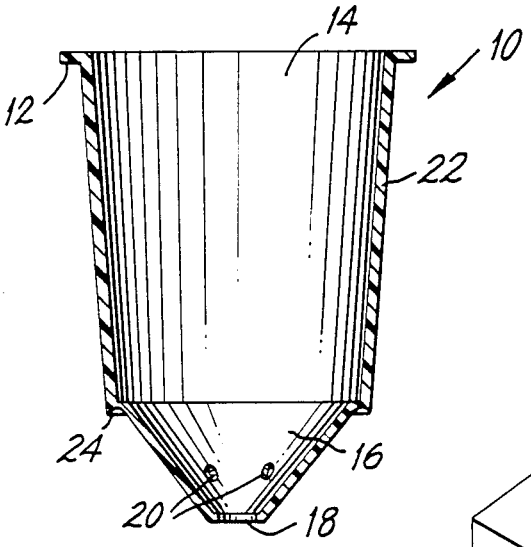
FIG. 2 is a sectional elevation of the FIG. 1 liner as would be seen from plane II—II of FIG. 1.

Referring to FIGS. 1–3, refuse liner 10 of the invention is desirably constituted in integral form in synthetic plastic, including a large lip 12 at its upper portion 14 extending radially outwardly of the liner. Upper liner portion 14 is of generally cylindrical outline extending from such lip to a lower portion 16 of frustro-conical outline and extending to a bottom or base flat of rather small measure and including drainage opening 18. Other drainage openings 20 are included in the wall of lower portion 14.

Upper portion 14 has sidewall 22 continuous with lip 12 and extending downwardly to upper portion lower surface 24, which is configured with a gripping detent 26, unlike the heretofore known liner above discussed. Such gripping detent 26 has a course 28 extending from surface 24 arcuately upwardly and then arcuately downwardly continuously with lower portion 16. Portion 16 includes a conically, radially inwardly tapered sidewall 30, which terminates in such base flat surface opening 18.

The aforementioned difficulty in the handling of liners heretofore known, i.e., in respect of daily collection activity, is thus overcome in that the lip 12 is radially extended in order to provide a hand gripping ledge at the top of the liner, and in that there is provided the lower gripping detent 26, whereby manual handling of the liner to remove same from parent structure below discussed is facilitated. In this handling, a worker lifts the liner from the parent collection bin or base by engaging lip 12 and, in the course of withdrawal of the liner from the bin, engages also lower gripping detent 22 and inverts the liner to dispel its contents into the daily collection unit.

Figure 4:
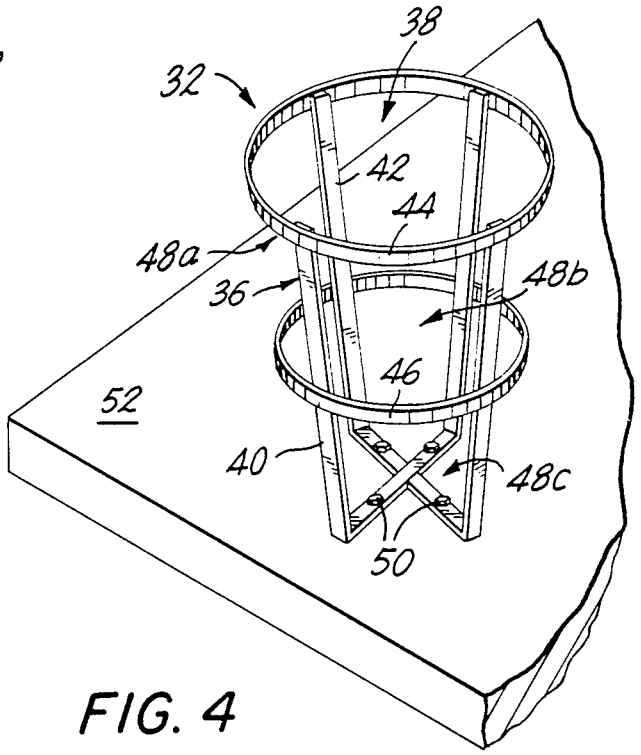
FIG. 4 is a perspective view of a base for receiving the FIG. 1 liner.
Figure 6:
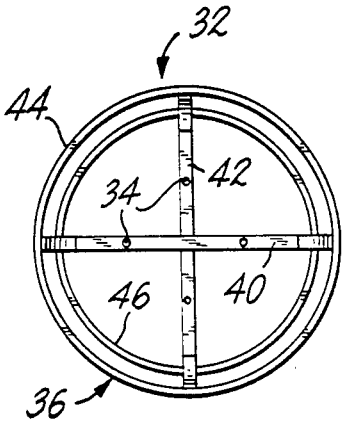
FIG. 6 is a plan view of the FIG. 4 apparatus.
Figure 5:
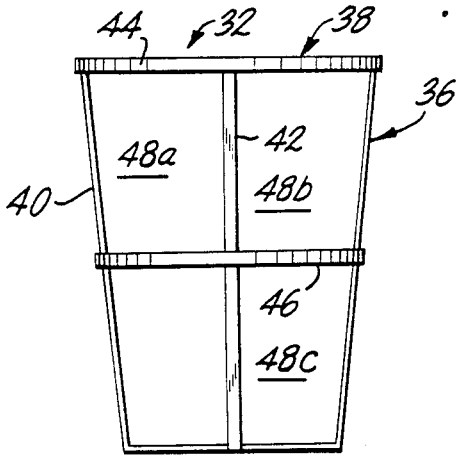
FIG. 5 is a front elevation of the FIG. 4 apparatus.

Turning now to FIGS. 4, 5 and 6, apparatus for use in refuse collection and disposal comprises base 32, which is adapted for securement to a substrate through holes 34. Base 32 defines an upstanding frame 36 having an uppermost opening 38 for releasable receipt of a refuse liner, the frame being configured such as to generally preclude base 32 from containment of refuse therein in the absence of residence of the refuse liner therein. To this end, frame 36 comprises first members 40 and 42 extending vertically with base 32 and second members 44 and 46 extending perimetrically of the base. Frame 36 has a number of openings 48*a*, 48*b*, 48*c*, etc., each such opening being bounded by the first and second frame members, all such openings being of size to communicate visually to the passerby or potential user that the frame is not intended to or not likely to contain refuse when the liner is not in base 32. As such, it may be said that the linerless base generally effects a preclusion of refuse containment thereby, absent presence of the liner. In this respect, upstanding openings 48*a* and 48*b*, etc., are of size selected to particularly preclude containment thereby of customary small size, e.g., soda bottles, lunch bags, cigarette packages, coffee containers.

In the particularly shown embodiment of frame 36, the first members 40 and 42 comprise continuous courses extending from the uppermost base opening downwardly to the bottom of the base and horizontally thereacross and thence upwardly to the uppermost base opening. Mounting holes 34 are seen in the lower horizontal portion of each of the first members. Member 42 crosses atop member 40 in the horizontal course and is welded thereto at such crossover locations.

Likewise, in such preferred frame embodiment, the second members 44 and 46 comprise continuous courses extending perimeterically of the base at respective different vertical locations thereof, crossing first members 44 and 46 and welded thereto at such crossover locations.

Frame members may be tubular or flat or any combination thereof.

As shown in FIG. 4, mounting studs 50 are secured through holes 34 (FIG. 6) in concrete sidewalk 52 to permanently secure base 32 in place.

If desired, the upper portion of the base 32, for example, the area between members 44 and 46, may be partially or completely enclosed by smaller mesh openings or even by a sheet of material leaving no openings. The lower portion of the base 32, i.e., that portion lower than member 46 should have relatively large openings to preclude use of the base, without the liner, as a refuse container.

Figure 7:
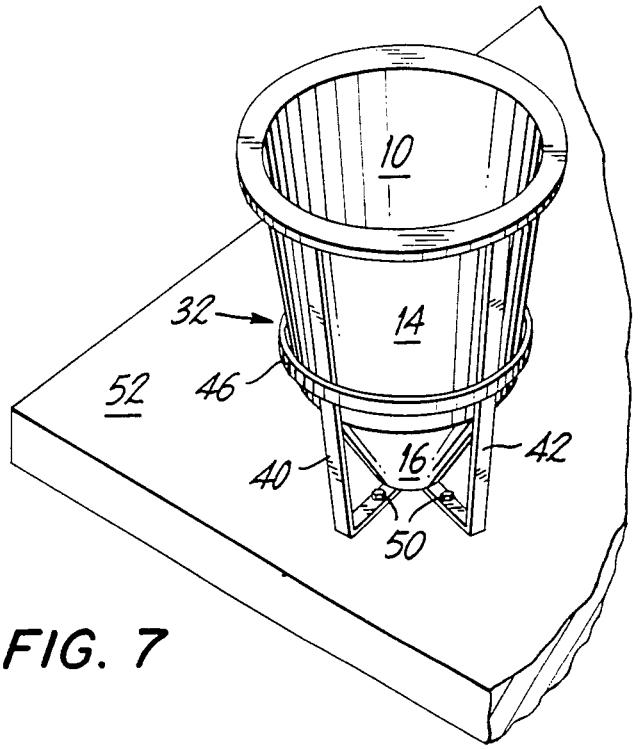
FIG. 7 is a perspective of the composite apparatus of the invention, inclusive of both the liner and base.

FIG. 7 shows the assembly of the liner and base. With the liner in place, and typically of brightly colored plastic, such as orange, a passerby now is presented visually with the full image of a refuse container intended for use and service.

Another embodiment of the invention is a base having in addition to a top opening, a side opening for removal of the liner in a sidewise direction rather than by lifting the liner completely above the top peripheral member of the base. This design may be achieved by having frame members 44 and 46, or just frame member 44 if desired, be part of circle instead of a full circular member as shown. This construction simplifies removal of the liner from the base particularly when the liner is filled with very heavy refuse.

Various changes may be introduced to the foregoing embodiments of liner and base without departing from the invention. For example, the base and liner may be used to receive various materials other than litter or refuse. The particularly depicted preferred embodiment thereof is thus intended in an illustrative and not in a limiting sense. The true spirit and scope of the invention is set forth in the following claims.

We claim:

1. A refuse liner comprising a non-self-standing body having an uppermost opening, a generally cylindrical portion extending downwardly from said opening, and a frustro-conical portion extending downwardly from such cylindrical portion, a lip extending radially outwardly of said cylindrical portion adjacent said opening and a gripping detent being formed in said cylindrical portion adjacent said frustro-conical portion.

2. The invention claimed in claim 1 wherein said frustro-conical portion includes a plurality of drainage openings therein.

3. In combination, a refuse liner comprising a non-self-standing body having an uppermost opening, a generally cylindrical portion extending downwardly from said opening, and a frustro-conical portion extending downwardly from such cylindrical portion, a lip extending radially outwardly of said cylindrical portion adjacent said opening, a gripping detent being formed in said cylindrical portion adjacent said frustro-conical portion and a base adapted for securement thereof to a substrate and defining an upstanding frame having an uppermost opening for releasable receipt of said refuse liner, said frame being configured such as to effect visible appearance generally precluding use of said base for deposit of refuse therein in the absence of residence of said liner therein, said liner being of an overall size and configuration to be removably contained within and supported by said base.

4. The invention claimed in claim 3 wherein said frame comprises first members extending vertically with said base and second frame members extending perimetrically of said base, said base having openings bounded by said first and second frame members, at least the openings in the lower portion of said base being of size to effect such visible appearance.

5. The invention claimed in claim 4 wherein said first members of said frame comprise continuous courses extending from said uppermost frame opening downwardly to a bottom of said base and thereacross and thence upwardly to said uppermost frame opening.

6. The invention claimed in claim 5 wherein said second members of said frame comprise continuous courses extending perimetrically of said base at respective different vertical locations thereof.

7. The invention claimed in claim 6 wherein said first members define mounting openings in such courses thereof extending across said base.

* * * * *